US006520663B1

(12) United States Patent
Holmes et al.

(10) Patent No.: US 6,520,663 B1
(45) Date of Patent: Feb. 18, 2003

(54) UV CURING LAMP ASSEMBLY

(75) Inventors: Mark Holmes, Waterford, CT (US); John P. Breault, New Britain, CT (US)

(73) Assignee: Henkel Loctite Corporation, Rocky Hill, CT (US)

( * ) Notice: Subject to any disclaimer, the term of this patent is extended or adjusted under 35 U.S.C. 154(b) by 10 days.

(21) Appl. No.: 09/814,011

(22) Filed: Mar. 21, 2001

Related U.S. Application Data

(60) Provisional application No. 60/191,674, filed on Mar. 23, 2000.

(51) Int. Cl.[7] ..... F21V 19/02

(52) U.S. Cl. ..... 362/285; 362/287; 362/288; 362/289; 362/370; 362/372; 362/277; 362/284; 362/371; 362/429; 250/504 R

(58) Field of Search ..... 362/285, 287, 362/288, 289, 370, 372, 277, 282, 284, 371, 427, 429, 428; 250/504 R, 493.1

(56) References Cited

U.S. PATENT DOCUMENTS

| | | | | | |
|---|---|---|---|---|---|
| 3,341,731 | A | | 9/1967 | Wilson | 313/113 |
| 3,648,045 | A | | 3/1972 | La Vantine et al. | 362/265 |
| 3,953,726 | A | | 4/1976 | Scarritt, Sr. | 362/465 |
| 4,460,942 | A | | 7/1984 | Pizzuti et al. | 362/217 |
| 4,510,558 | A | | 4/1985 | van der Brink | 362/263 |
| 4,729,065 | A | * | 3/1988 | Bahnemann et al. | 362/232 |
| 4,729,077 | A | | 3/1988 | Gordin et al. | 362/285 |
| 4,754,373 | A | | 6/1988 | Otto et al. | 362/547 |
| 4,866,330 | A | | 9/1989 | Lacruche et al. | 313/146 |
| 4,954,938 | A | | 9/1990 | Lyons | 362/298 |
| 4,959,583 | A | | 9/1990 | Arsena et al. | 313/113 |
| 5,050,044 | A | | 9/1991 | Shibayama | 362/18 |
| 5,369,557 | A | | 11/1994 | Ronney | 362/285 |
| 5,386,173 | A | | 1/1995 | Kosmatka | 313/318.01 |
| 5,387,800 | A | | 2/1995 | Kurtich et al. | 250/504 R |
| 5,412,275 | A | | 5/1995 | Dorsemagen et al. | 313/318.01 |
| 5,440,137 | A | | 8/1995 | Sowers | 250/504 R |
| 5,506,464 | A | | 4/1996 | Ooms | 313/113 |
| 5,515,255 | A | | 5/1996 | Nielson et al. | 362/297 |
| 5,789,850 | A | | 8/1998 | Iwafuji et al. | 313/318.08 |
| 5,803,595 | A | | 9/1998 | Verspaget et al. | 362/374 |
| 5,803,729 | A | | 9/1998 | Tsimerman | 433/29 |
| 5,806,971 | A | | 9/1998 | Sugihara et al. | 362/264 |
| 6,000,815 | A | * | 12/1999 | Jennings | 362/285 |
| 6,227,681 | B1 | * | 5/2001 | Shoemaker et al. | 362/269 |

OTHER PUBLICATIONS

"HBO Mercury Short Arc Lamps", OSRAM Sylvania, OCN–1066 9/88.

* cited by examiner

*Primary Examiner*—Alan Cariaso
*Assistant Examiner*—Sharon Payne
(74) *Attorney, Agent, or Firm*—Hoffman & Baron, LLP

(57) ABSTRACT

A UV curing lamp assembly permits adjustable positioning of a UV curing lamp with respect to a bracket supporting a reflector. The assembly includes an elongate UV lamp having opposed ends. A reflector having a central base and a curved reflective wall includes a pair of opposed openings through the reflector wall for passage of the UV lamp therethough. A bracket adjustably supports the reflector and the lamp. The bracket includes a bracket body movably supporting a mounting member for adjustably supporting the reflector with respect to the bracket body. A support arm extends from the bracket body towards one of the openings in the reflector. The support arm adjustably supports one of the ends of the UV lamp with respect to the reflector.

24 Claims, 7 Drawing Sheets

UV CURING LAMP ASSEMBLY

CROSS REFERENCE TO RELATED APPLICATION

The present invention is a non-provisional application, which claims priority to U.S Provisional patent application Ser. No. 60/191,674 filed, Mar. 23, 2000, and which is incorporated by reference herein.

FIELD OF THE INVENTION

The present invention relates generally to a lamp assembly for a UV spot curing system. More particularly, the present invention relates to a UV curing lamp assembly including a lamp, a reflector and a bracket adjustably supporting the reflector and the lamp.

DISCUSSION OF THE RELATED ART

It is well known to use UV lamps to cure certain curable compounds such as adhesives and the like. In situations where the compounds are deposited at precise locations with respect to a work piece, it is often necessary to provide a lamp which will spot cure the compound at the precise location.

Commercially available spot curing lamp assemblies typically include a UV lamp and a reflector. The UV lamp and the reflector are fixed relative to one another so as to accurately direct the UV energy emanating from the lamp. Conventional lamp assemblies include an elongate lamp having electrical terminals at opposite ends thereof. The lamp includes a radiation emitting portion such as the arc of a mercury vapor lamp positioned centrally between the ends of the lamp. Typically, such elongate lamps are mounted within a curved reflector with one end of the lamp supported at the base of the reflector and the other end of the lamp extending. outwardly therefrom. The end supported at the base of the reflector fixes the position of the lamp with the radiation emitting portion of the lamp being precisely positioned with respect to the reflector so as to maximize radiation output.

While mounting the lamp at only one end to the reflector affords a certain degree adjustability with respect thereto, it is difficult to fix the position of the lamp with respect to the reflector once it is accurately positioned. Further, mounting the lamp to the base of the reflector at one end, positions the opposite end of the lamp and its associated electrical terminal, in the path of the reflected radiation. This can interfere with the accurate radiation output as well result in reduction in the useful life of the lamp.

Further improvements in lamp assemblies are shown in U.S. Pat. No. 5,387,800. As shown therein, a prefocused lamp assembly includes a bracket which supports a reflector. The reflector includes a pair of opposed openings through its curved wall so as to accommodate the elongate lamp in a vertical orientation with respect to the reflector. The ends of the lamp extend through the holes in the reflector. The ends of the lamp are each fixed to the bracket by spaced apart cantilevered arms. Adjustability of the lamp with respect to the reflector is achieved by permitting movement of the reflector with respect to the bracket. Once the reflector is properly positioned with respect to the lamp, the base of the reflector is potted to fix the reflector to the bracket.

As may be appreciated, the lamp assembly shown in the '800 patent is complex to manufacture. The lamp is held at both ends in a fixed position with respect to the bracket while the reflector is moved relative to the fixed lamp to provide the required adjustment. This arrangement makes it more difficult to accurately align the lamp with respect to the reflector. Once the precise position of the lamp with respect to the reflector is achieved, the reflector is permanently secured to the bracket. This prevents any further adjustment which may be necessary between the lamp and the reflector. As the reflector is permanently fixed to the bracket, the lamp and the reflector become essentially a unitary structure. Thus, once the reflector is attached to the bracket, the lamp itself is nonreplaceable. After the lamp is spent, the entire assembly must be replaced.

Moreover, when powered, these lamps generate a significant amount of heat. This heat tends to cause expansion of components of the lamp assembly. In situations where the lamp is fixed at both ends to a bracket, relative different rates of expansion of the components causes a significant force to be transferred to the lamp. This force could be damaging to the lamp. Certain relevant industry standards, such as those set forth by OSRAM/Sylvania, require that the lamp not be fixed at both ends.

It is, therefore, desirable to provide a UV curing lamp assembly where the assembly may be more economically and accurately manufactured and where the components of the assembly may be reused, disposing only of the lamp after it is spent.

SUMMARY OF THE INVENTION

The present invention provides a UV curing lamp assembly including an elongate UV lamp having opposed ends. The lamp includes electrical terminals at each of the opposed ends for applying electrical power to the lamp. The assembly further includes a reflector having a central base and a curved reflective wall extending from the base. The reflector includes a pair of opposed openings through the wall for passage of the opposed ends of the UV lamp therethrough. A bracket is adjustably supported to the reflector. The bracket includes a bracket body movably supporting a mounting member for adjustably supporting the base of the reflector to the bracket body. The bracket further includes a support arm extending from the bracket body so as to overlie one of the openings of the curved reflective walls. The support arm adjustably supports one of said opposed ends of the UV lamp with respect to the reflector.

In one embodiment of the present invention, one end of the lamp is removably secured in a lamp holder. The lamp holder is adjustably supported by the support arm to provide adjustable relative movement between the lamp and the reflector. The mounting member is an elongate member having the reflector mounted at one end thereof. The mounting member is slidably positionable with respect to the bracket body so as to permit adjustable movement of the reflector with respect to the bracket body. Movement of the mounting member with respect to the bracket body may be achieved under a spring bias.

The present invention thus provides for adjustable mounting of the lamp with respect to the reflector with adjustability in a first linear direction. Further, the mounting member provides for relative adjustable movement of the reflector with respect to the lamp in a second linear direction perpendicular to the first direction. Adjustment of the lamp with respect to the reflector in both directions provides for the operable positioning of the lamp with respect to the reflector so as to maximize radiation output.

In another embodiment the lamp may be positioned for adjustable movement in a third, substantially linear direction and mutually perpendicular to both the first and second linear directions.

Furthermore, by adjustably supporting the lamp to the bracket at only one end of the lamp, expansion of the components of the lamp assembly due to induced heat, will not transmit stresses to the lamp or the electrical connections maintained at each end of the lamp. Additionally, the bracket assembly of the present invention permits replacement of the lamp within the assembly after the lamp is spent.

DETAILED DESCRIPTION OF THE INVENTION

Figure 1:
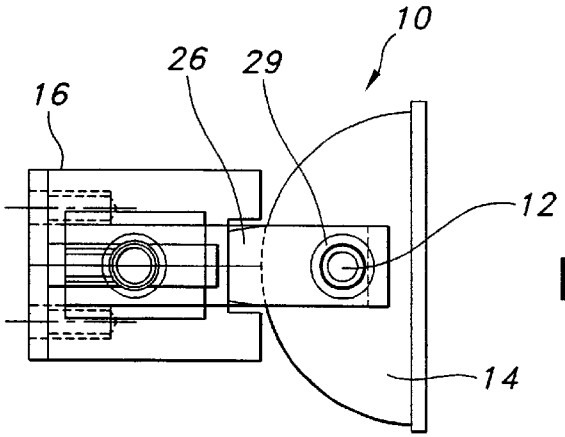
FIGS. 1–4 show top, rear, side and front elevational views respectively, of one embodiment of the lamp assembly of the present invention.
Figure 4:
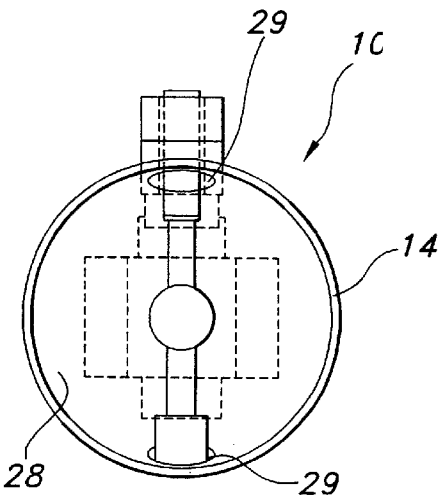
Figure 3:
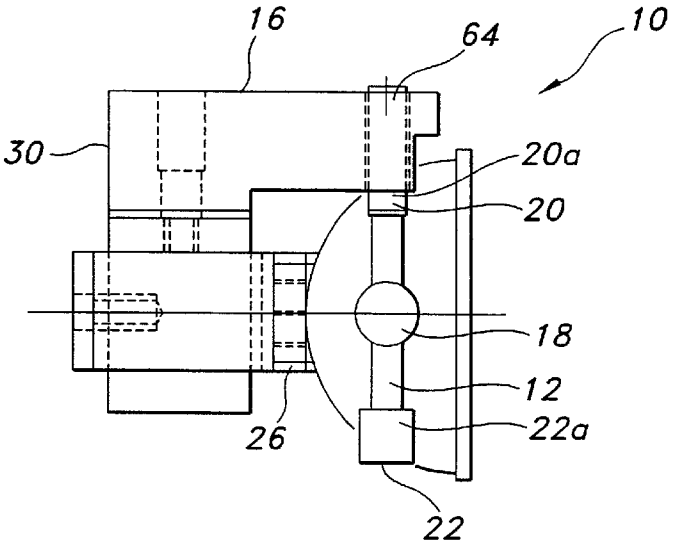
Figure 2:
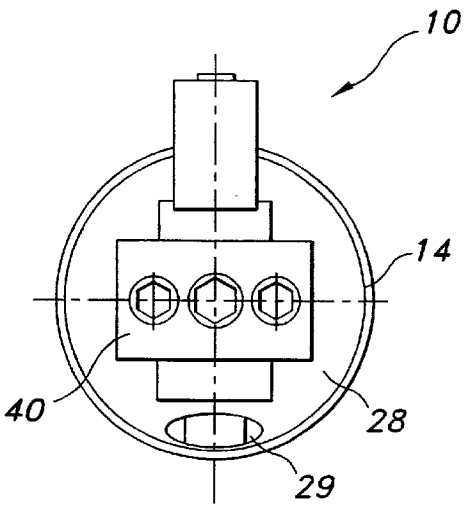

The present invention provides a UV curing lamp assembly which may be particularly used for spot curing an adhesive on a work piece. The UV curing lamp assembly of the present invention provides a UV lamp and a reflector where the UV lamp and the reflector are mounted for relative adjustability therebetween to assure that the energy emitted by the UV lamp is effectively and efficiently directed at a precise desired location.

Referring now to the drawings, FIGS. 1–6 show various views of the UV curing lamp assembly 10 of the present invention. Curing lamp assembly 10 includes a UV lamp 12, a reflector 14 and a bracket assembly 16 which adjustably supports the UV lamp 12 with respect to the reflector 14.

The lamp 12 is generally of elongate shape having a central bulb portion 18 and a pair of spaced apart aligned ends 20 and 22. The ends 20 and 22 respectively include exteriorly accessible electrical terminals 20*a* and 22*a* thereat which permit connection of electrical current to a radiation emitting device 24 housed within bulb 18.

The lamp 12 of the present invention is a commercially available lamp of the type known as a mercury short arc lamp. Lamps of these types are commonly used in industrial applications so as emit ultraviolet radiation used in curing operations. While the lamp shown herein is preferred for use with the present invention, it is contemplated that other radiation emitting lamps may also be employed.

In order to more accurately and efficiently focus the radiation emitted by lamp 12, the lamp is used in combination with reflector 14. Reflector 14 may be an elliptical reflector having a ceramic base 26 and a generally curved parabolic wall extending from the base. The curved elliptical wall 28 defines a concavity which is designed to house at its focal point, the bulb 18 of lamp 12. As is well known in the art, accurate alignment of the bulb 18 of lamp 12 with the curved wall 28 of reflector 14 provides for the efficient and accurate focusing of the energy emitted by lamp 12 onto a spot location such as an adhesive on a work piece surface. While reflector 14 preferably includes an elliptical wall, other useful configurations such as a parabolic may also be employed in accordance with the present invention.

The present invention provides for the curved wall 28 of reflector 14 to include a pair of aligned generally diametrically opposed openings 29 therethrough which permit the passage of ends 20 and 22 of lamp 12. Thus, the lamp 12 may be positioned with respect to reflector 14 with the bulb 18 generally residing within the concavity of the reflector and the ends 20 and 22 extending exteriorly thereof The ends are exteriorly accessible so as to provide both for exterior electrical connection and adjustability of the lamp with respect to the reflector.

In order to provide for the accurate adjustable positioning of the bulb 18 of lamp 12 within a curved wall 28 of reflector 14, the present invention provides bracket assembly 16 which supports both the lamp 12 and the reflector 14 in adjustable fashion.

Figure 5:
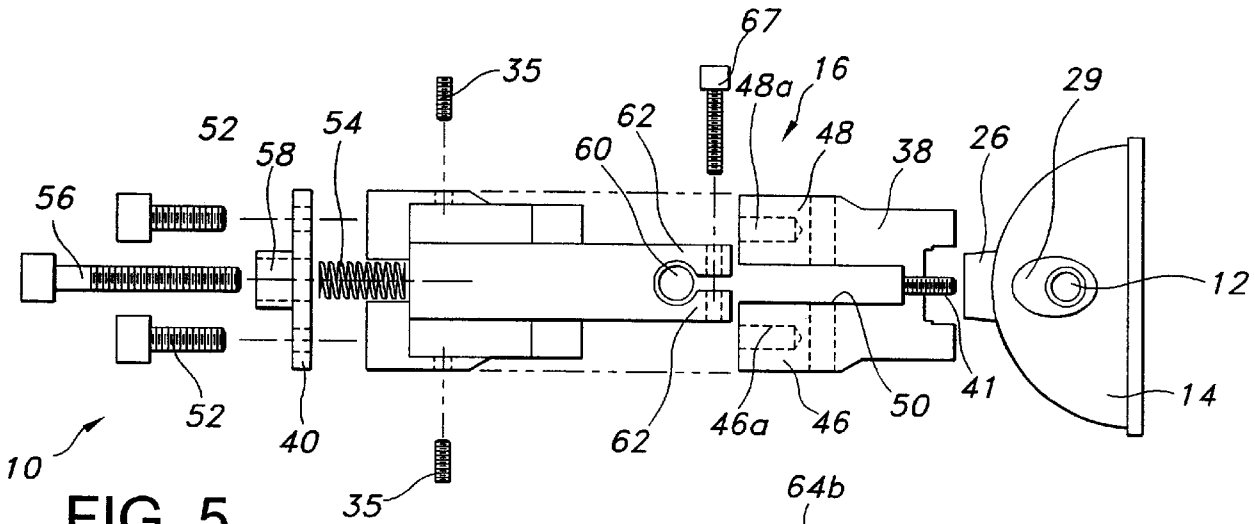
FIGS. 5 and 6 show, respectively, exploded top and side views of the lamp assembly of the present invention.
Figure 6:
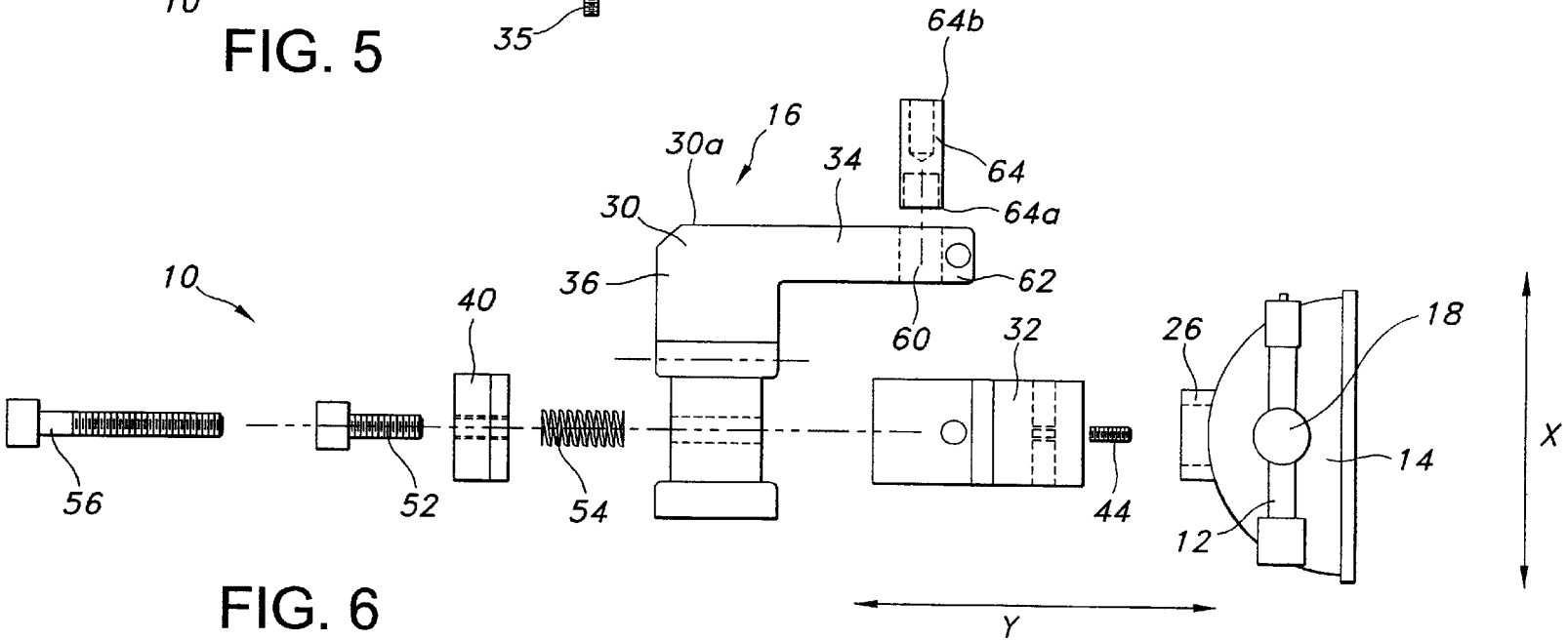
Figure 7:
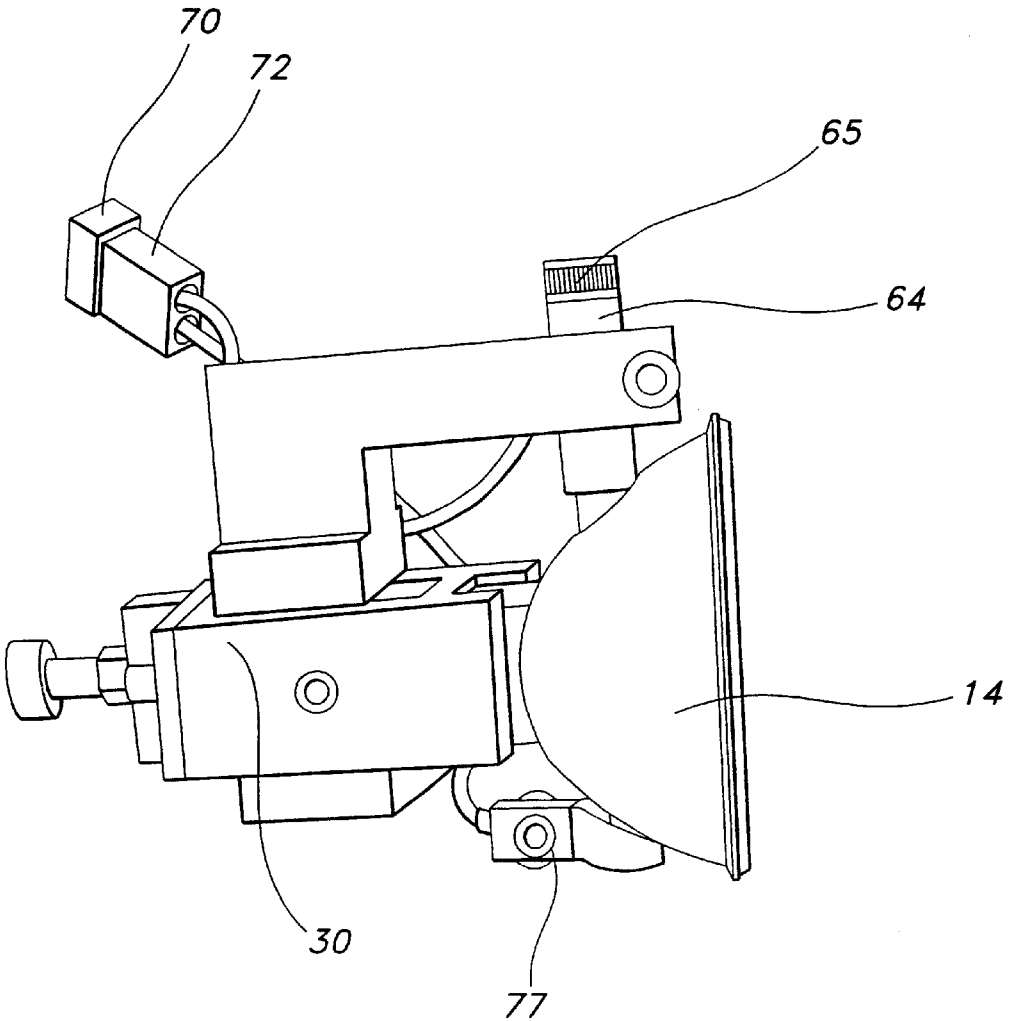
FIGS. 7–10 are side, front top and bottom perspective showings, respectively, of the lamp assembly of the present invention.
Figure 8:
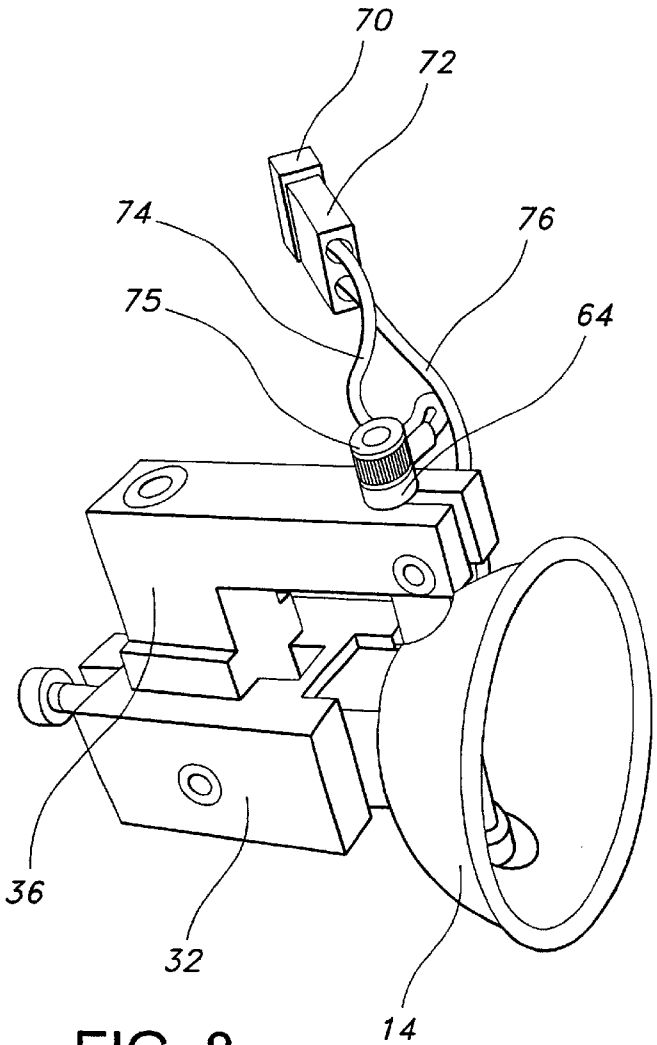
Figure 9:
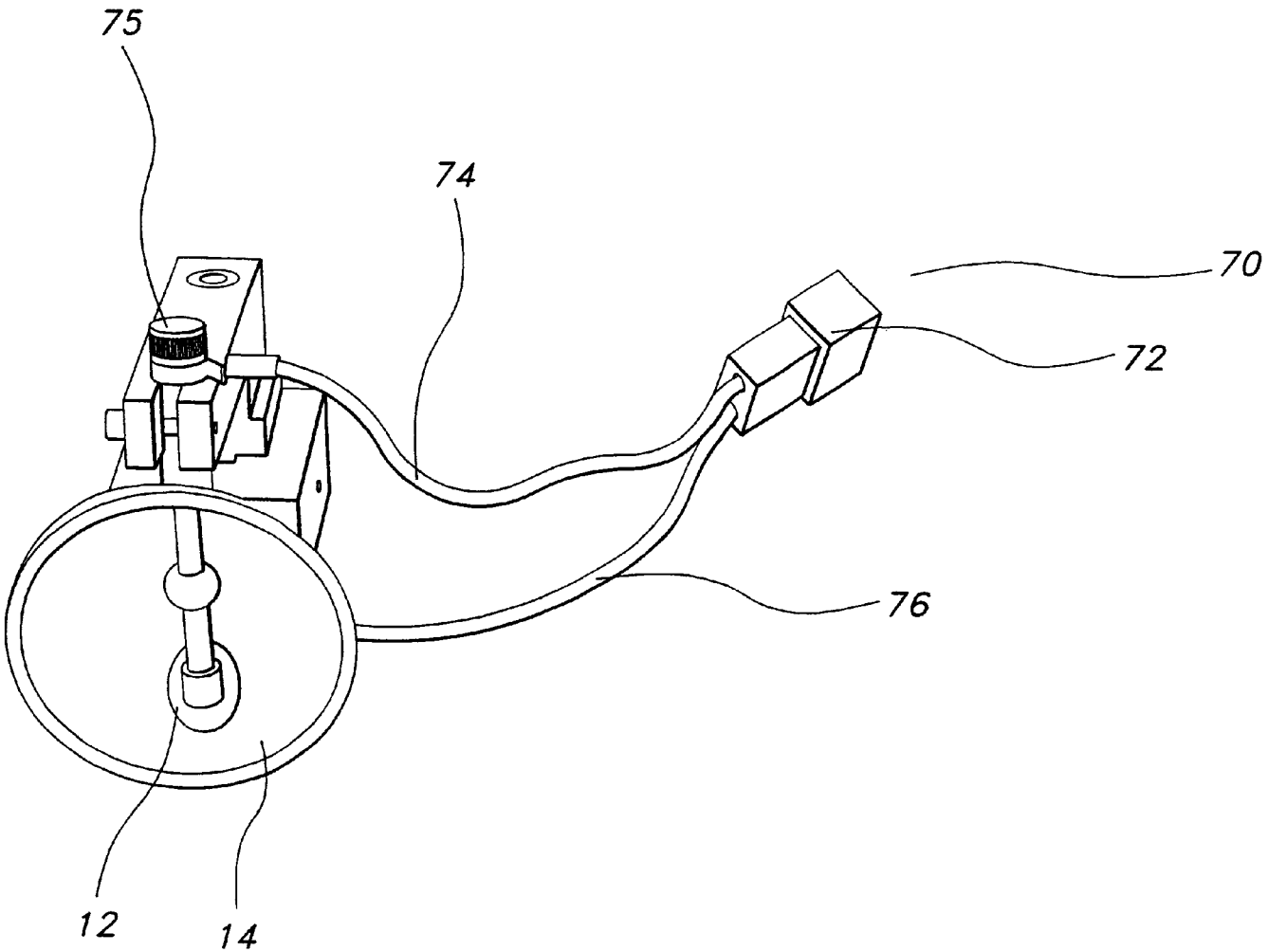
Figure 10:
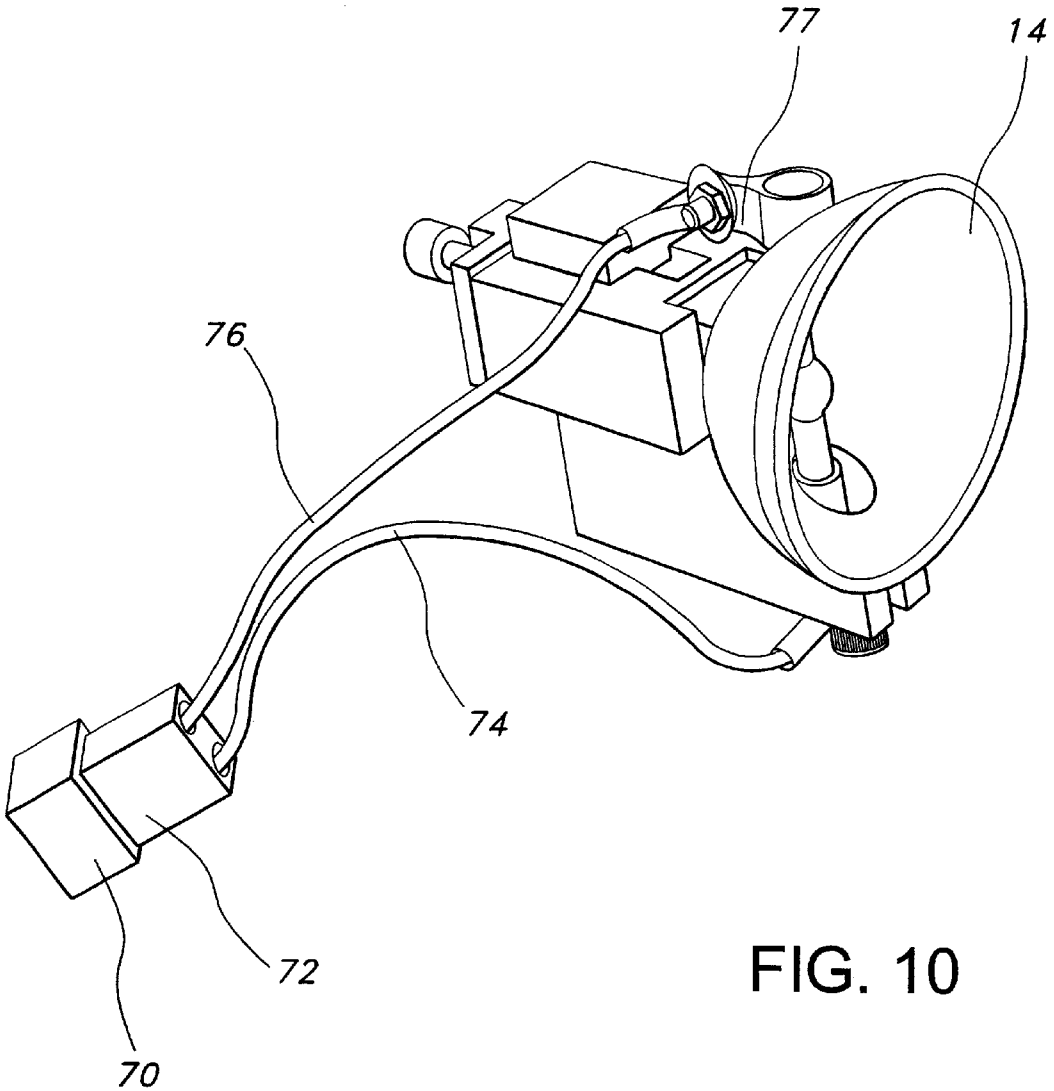

As shown in further detail in FIGS. 5 and 6, the bracket assembly 16 includes a bracket body 30 and a reflector mounting member 32 adjustably positionable with respect to body 30. Bracket body 30, which may be formed of metal components, is of generally right angle configuration including an elongate upright portion 36, having at one end 30*a* an elongate support arm 34 extending therefrom. The opposed end 30*b* of upright portion 36 includes an area of reduced thickness which is configured to support elongate reflector mounting portion 32 in transverse relationship thereto. Reflector mounting portion 32 is adjustably mounted to upright support 36 for movement in a direction generally parallel to support arm 34.

Reflector mounting member 32 includes a housing 38 and a transverse rear support plate 40 which supports housing 38 to the lower end 30*b* of upright portion 36. Housing 38 includes front surface 42 to which base 26 of reflector 14 may be mounted. In that regard, a mounting screw 44 extends from front surface 42 to removably secure reflector 14 thereto. It is contemplated that once the reflector is properly secured to front surface 42 of housing 38 with mounting screw 44, the reflector may be permanently secured thereto by the application of an adhesive, such as epoxy.

The rear portion of housing 38 includes a pair of transversely spaced rearwardly extending parallel legs 46 and 48. Legs 46 and 48 define therebetween an elongate open-ended slot 50 extending from front surface 42. Slot 50 is configured to accommodate the reduced-thickness opposed end 30*b* of upright portion 36. The ends of parallel legs 46 and 48 may be secured to rear plate 40 about opposed end 30*b* by a pair of mounting screws 52 extending through plate 50 and into screw receiving bores 46*a* and 48*a* of each of legs 46 and 48. Slot 50 is of sufficient length so that when secured to end plate 40, reflector mounting portion 32 is transversely moveable with respect to upright portion 36 of bracket body 30.

In order to permit adjustable movement of reflector mounting portion 30 and thereby reflector 14 secured thereto, a compression spring 54 is supported in reflector mounting portion 30 between rear support plate 40 and housing 38. An adjustment screw 56 may be interposed through rear plate 40 and into engagement with spring 54. In order to accommodate adjustment screw 56, rear plate 40 includes an extending collar 58. Movement of adjustment screw 56 causes movement of reflector mounting portion 32 under and against the bias of compression spring 54. Thus, adjustment screw 56 provides for the adjustable movement of reflector mounting portion 32 and thereby reflector 14 with respect to bracket body 30. The reflector mounting portion 32, once properly adjusted, may be secured to bracket body 30 by a pair of lateral set screws 35. The set screws 35 extend through side passages 51 in legs 46 and 48 and against upright portion 36 to fix the position of mounting portion 32.

Lamp 12 is adjustably secured to bracket body 30 at the distal end 34*a* of support arm 34. The distal end 34*a* of support arm 34 is configured in a clamp-like configuration. As particularly shown in FIG. 5, the distal end 34*a* includes a central transverse aperture 60 and a pair of spaced apart extending arms 62. The distal end 34*a* of support arm 34 is positioned to overlie one of opening 29 of reflector 14 so as to position lamp 12 within reflector 14. Aperture 60 is designed to accommodate a lamp holder 64 therein. Lamp holder 64 is generally an elongate cylindrical member having a lower end 64*a* and an opposite upper end 64*b*. The lower end 64*a* includes a recess 63 for removably accommodating the end 20 of lamp 12. Lamp holder 64 is formed of a conductive metal so as to place the lamp holder in conductive engagement with electrical terminal 20*a* at the end 20 of lamp 12. Lamp holder 64 also includes a recess 65 at the opposite end thereof for accommodating an electrical connection device used to secure an electrical lead thereto as shown in FIGS. 7–10 and as will be described in further detail hereinbelow.

Elongate lamp holder 64 is adjustably and removably positionable within aperture 60 so as to adjust the position of lamp 12 in a direction transverse to support arm 34. Once the proper relative position of lamp 12 is achieved, a locking screw 67 may be interposed through arms 62 and tightened to clamp lamp holder 64 within the distal end 34*a* of support arm 34. This fixes the position of lamp 12 with respect to support arm 34 and thereby reflector 14.

Having described the components of the UV curing lamp assembly of the present invention, its operation in adjustably securing lamp 12 with respect to reflector 14 may be described. Lamp assembly 10 is provided with the reflector 14 secured to mounting portion 32 of bracket assembly 16. Lamp 12 may be inserted into reflector 14 with the ends 20 and 22 extending respectively out of opposed openings 29. End 20 of lamp 12 is then inserted into lamp holder 64 which is loosely positioned within aperture 60 of support arm 34. As may be appreciated, lamp 12 and reflector 14 may be relatively positioned with respect to both a vertical axis X as well as a horizontal axis Y as depicted in FIG. 6.

Vertical adjustment as shown in FIG. 6 along axis X may be achieved by adjusting the position of the lamp holder 64 within aperture 60. The lamp holder 64 is moveable within the clamp-like distal end 34*a* of support arm 34 until proper X-axis positioning of the central portion 18 of lamp 12 is achieved. Once such a positioning is achieved, the locking screw 65 may be interposed through the distal end 34*a* of support arm 34 to securely position the lamp holder and thereby the lamp to support arm 34. Once the X axis positioning of lamp 12 is achieved, the central portion 18 of lamp 12 may be relatively positioned along the Y axis with respect to reflector 14. Such positioning is achieved by adjustable movement of reflector mounting portion 32 with respect to bracket body 30. Adjustment screw 56 may be moved so as effect movement of the reflector mounting portion 32 along the Y axis until proper positioning of the reflector 14 with respect to central portion 18 of lamp 12 is achieved. Once such positioning is achieved, lateral set screws 35 may be used to secure reflector mounting portion 32 in proper position with respect to bracket 30.

The proper positioning of central portion 18 of lamp 12 with respect to reflector 14 may be achieved by use an alignment fixture (not shown) which is commonly used in the industry to effect proper placement of the lamp with respect to the reflector. The position of the lamp with respect to the reflector along both the X and Y axis may be accomplished by continuously monitoring the light emitting from the lamp while adjustment is taking place. Once maximum efficiency is achieved, the position of the lamp with respect to the reflector may be fixed. In this regard, while adjustment has been described with respect to adjusting the X axis position and then adjusting the Y axis position of the lamp with respect to the reflector, it may be appreciated that constant and continual adjustment in both axes may be necessary until a proper position is achieved. By adjustably securing the lamp 12 to assembly 10, the present invention permits such continuing adjustment.

Referring now to FIGS. 7–10, once the lamp 12 is fixed with respect to the reflector, the lamp may be electrically connected to a power source (not shown). An electrical connection assembly 70 may be used. Connection assembly 70 includes an electrical connector 72 including a pair of electrical leads 74 and 76 extending therefrom. Leads 74 and 76 may be respectively attached to the opposite ends 20 and 22 of lamp 12. Lead 74 may be connected to end 20*a* through conductive lamp holder 64 which fixes the position of lamp 12 with respect to reflector 14. A screw terminal 75 inserted into recess 65 to establish electrical connector. End 22 of lamp 12 may be connected to lead 76 by a loose compression connector 77 at the end thereof The compression connector establishes electrical connection between the end 22 and lead 74 without fixing the position of end 22.

Figure 11:
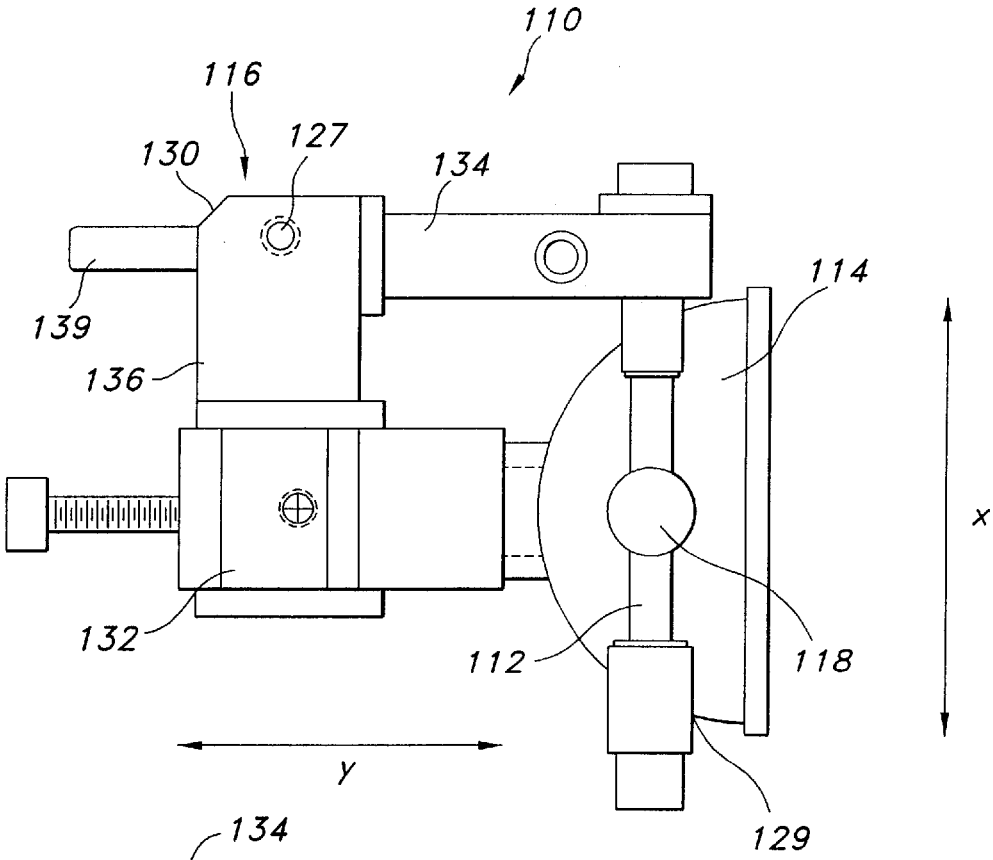
FIG. 11 is a side elevational showing of a further embodiment of the lamp assembly of the present invention.
Figure 12:
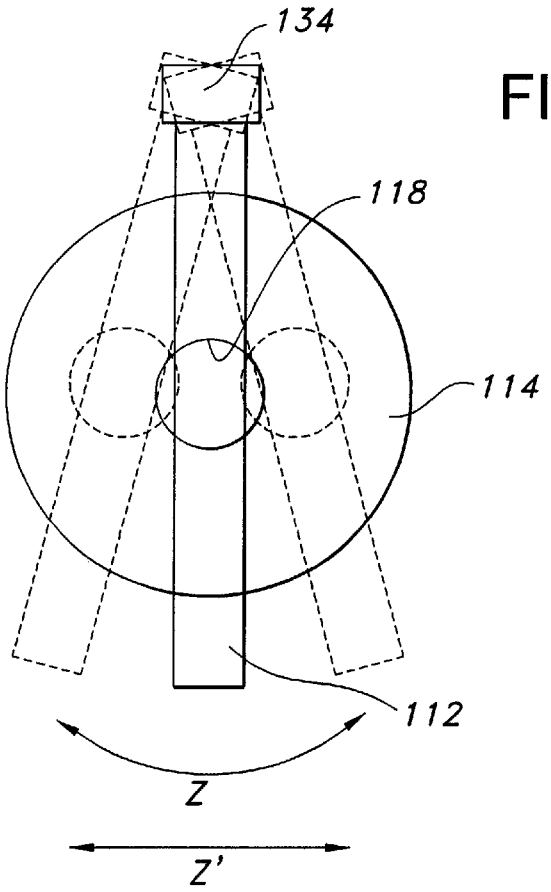
FIG. 12 is a front schematic representation of the embodiment of FIG. 11.

Referring now to FIGS. 11 and 12, a further embodiment of the lamp assembly of the present invention is shown. Lamp assembly 110 is substantially similar to lamp assembly 10 described above with respect to FIGS. 1–10. As such, similar reference numerals will be used to denote similar components.

Lamp assembly 110 includes a UV lamp 112 and a reflector 114 of the type described above. A bracket assembly 116 which is substantially similar to bracket assembly 16 described above includes a bracket body 130 and a support arm 134 extending from an upright portion 136. The bracket assembly 116 permits movement of lamp 112 with respect to reflector 114 in an X-direction by adjustably supporting one end of lamp 112 at a distal end of elongate support arm 134. Similarly, lamp 112 is adjustable in the Y-direction with respect to reflector 114, by the mounting of reflector 114 to a reflector mounting member 132 movably supported to the upright portion 136.

In the embodiment of FIGS. 11 and 12, the mounting of support arm 134 to upright portion 136 of bracket body 130 permits additional directional movement of lamp 112 with respect to reflector 114. In the present embodiment support arm 134 is secured to upright portion 36 so that it may be pivotally rotated with respect thereto. In that regard, support arm 134 includes a rearwardly extending knob 139 which is rotatable so as to effect rotative movement of support arm 134.

As shown particularly in FIG. 12, rotative movement of support arm 134 with respect to reflector 114 causes a corresponding pendulum-type movement of lamp 112 in the direction of arrow Z. For clarity of description, the pendulum-type movement of lamp 112 with respect to reflector 114 is greatly exaggerated in FIG. 12. In actuality, the rotative movement of support arm 134 is relatively slight thereby causing only a slight pendulum-type movement of lamp 112. Obviously, lamp 112 can only move a distance permitted by the expanse of opening 129 through the curved wall 128 of reflector 114. In fact, such movement of lamp 112 caused by the rotation of support arm 134 is so small that the actual movement of bulb 118 of lamp 112 is more in a linear manner along arrow Z'. Thus, the embodiment of FIGS. 11 and 12 permit movement of bulb 118 with respect to reflector 114 in a third substantially linear direction which is mutually perpendicular to the first and second directions. This allows more accurate positioning of the bulb 118 with respect to the reflector 114 so as to more accurately and efficiently direct the radiation emitted by lamp 112 onto securing location. Once the proper Z direction position of lamp 112 is achieved by the rotation of support arm 134, the rotatable position of support arm 134 may be fixed with set screw l27 which extends through the upper end of upright portion 136. p The invention being thus described, it will be clear to those skilled in the art that the same may be varied in many ways. Such variations are not to be regarded as a departure from the spirit and scope of the invention and all modifications are intended to be included within the scope of the claims.

What is claimed is:

1. A UV-curing lamp assembly comprising:

an elongate UV lamp having opposed ends including electrical terminals thereat;

a reflector having a central base and a curved reflective wall extending therefrom including a pair of opposed openings through said wall for passage of said opposed ends of said UV lamp therethrough; and a bracket adjustably supporting said reflector with respect to said lamp, said bracket including a bracket body movably supporting a mounting member for adjustably supporting said reflector with respect to said bracket body and a support arm extending from said bracket body towards one of said openings of said curved reflector wall, said support arm adjustably supporting one of said opposed ends of said UV lamp with respect to said reflector.

2. A lamp assembly of claim 1 wherein said support arm provides for adjustable mounting of said lamp along a first direction with respect to said reflector.

3. A lamp assembly of claim 2 wherein said mounting member provides for adjustable mounting of said reflector with respect to said lamp along a second direction perpendicular to said first direction.

4. A lamp assembly of claim 1 wherein said support arm includes a conductive lamp holder adjustably mounted in said support arm for establishing electrical engagement with said electrical terminal of said one of said opposed ends of said lamp.

5. A lamp assembly of claim 1 wherein said one end of said lamp is removably secured in said lamp holder, said lamp holder being adjustable with respect to said support arm to provide adjustable relative movement between said lamp and said reflector.

6. A lamp assembly of claim 5 further including means for adjustably fixing said lamp holder with respect to said support arm.

7. A lamp assembly of claim 6 wherein said adjustable fixing means includes said support arm including a compressible clamp-like distal end for accommodating said lamp holder, said clamp like end be compressible about said lamp holder to provide reliable securement of said lamp-holder to said support arm.

8. A lamp assembly of claim 7 wherein said adjustable fixing means further includes a fastener for compressibly securing said lamp holder in said clamp-like distal end.

9. A lamp assembly of claim 1 wherein said mounting member is an elongate member having a reflector mounting end, said mounting member being slidably positioned with respect to said bracket body to effect adjustable mounting of said reflector with respect to said bracket body.

10. A lamp assembly of claim 9 wherein said mounting member includes a fixed surface attached to said bracket body and a moveable element supporting said reflector and movable with respect to said fixed surface and means for adjustably moving said moveable element with respect to said fixed element.

11. A lamp assembly of claim 10 wherein said adjustable mounting means includes a manually adjustable fastener insertable through said fixed surface and engageable with said moveable element, wherein movement of said adjustable fastener effects movement of said moveable element.

12. A lamp assembly of claim 11 wherein said adjustable moving means further includes a compression spring interposed between said adjustable fastener and said movable element for mounting said moveable element under the bias of said spring.

13. A lamp assembly of claim 12 further including means for positionally fixing said mounting member with respect to said bracket body.

14. A lamp assembly of claim 13 wherein said fixing means includes a set screw engageable with said mounting member and said bracket body.

15. A lamp assembly of claim 3 wherein said support arm provides for adjustable mounting of said lamp along a third direction substantially perpendicular to said first and second directions.

16. A lamp assembly of claim 14 wherein said support arm is rotatably movable with respect to said bracket body.

17. A method for adjustably supporting an elongate UV-curing lamp with respect to a reflector comprising the steps of:

providing a bracket, said bracket including a bracket body and a reflector mounting member movably supported with respect to said body; said bracket body includes a support arm extending therefrom;

supporting said reflector with said reflector mounting member for movement with respect to said support arm in a first direction; and supporting one end of said lamp with said support arm for movement with respect to said support arm in a second direction perpendicular to said first direction.

18. A method of claim 17 wherein said reflector supporting step includes:

securing said reflector to said reflector mounting member.

19. A method of claim 17 wherein said lamp supporting step includes:

adjustably positioning said lamp with respect to said support arm.

20. A method of claim 19 wherein said adjustably positioning step includes:

providing a lamp holder adjustably supported by said support arm; and securing said one end of said lamp to said lamp holder.

21. A method of claim 18 wherein said reflector is secured to said reflector mounting member by an adhesive.

22. A method of claim 20 wherein said one end of said lamp is removably secured to said holder.

23. A method of claim 17 wherein said support arm is supported to said bracket body for rotative movement with respect thereto.

24. A method of claim 23 wherein said lamp supporting step includes movement of said lamp with respect to said reflector in a third direction substantially perpendicular to said first and second directions.

* * * * *

UNITED STATES PATENT AND TRADEMARK OFFICE

CERTIFICATE OF CORRECTION

PATENT NO. : 6,520,663 B1 
DATED : February 18, 2003
INVENTOR(S) : Holmes et al.

It is certified that error appears in the above-identified patent and that said Letters Patent is hereby corrected as shown below:

Title page,
Item [74], *Attorney, Agent, or Firm*, should read -- Hoffmann & Baron, LLP --.

Column 7,
Line 11, should read -- ...upright portion 136. The invention … --.

Signed and Sealed this

Second Day of December, 2003

JAMES E. ROGAN
*Director of the United States Patent and Trademark Office*